US007183885B2

(12) United States Patent
Nellessen, Sr. et al.

(10) Patent No.: US 7,183,885 B2
(45) Date of Patent: Feb. 27, 2007

(54) FERROUS FASTENER STARTER AND FERROUS OBJECT LOCATOR

(75) Inventors: John Nellessen, Sr., 21 Rock La., Castle Rock, CO (US) 80104; John Nellessen, Jr., Anaheim, CA (US)

(73) Assignee: John Nellessen, Sr., Anaheim, CA (US)

( * ) Notice: Subject to any disclaimer, the term of this patent is extended or adjusted under 35 U.S.C. 154(b) by 221 days.

(21) Appl. No.: 10/946,438

(22) Filed: Sep. 20, 2004

(65) Prior Publication Data

US 2006/0061444 A1 Mar. 23, 2006

(51) Int. Cl.
*H01F 7/02* (2006.01)

(52) U.S. Cl. ..... 335/302

(58) Field of Classification Search ..... 335/302–306; 324/662, 326, 67

See application file for complete search history.

(56) References Cited

U.S. PATENT DOCUMENTS

| | | | | |
|---|---|---|---|---|
| 2,723,369 | A | 11/1955 | Brummett | |
| 2,933,679 | A | 4/1960 | Bray | 324/207 |
| 3,363,208 | A | 1/1968 | Balet | 335/285 |
| 3,845,384 | A | 10/1974 | Stoutenberg | |
| 4,099,118 | A | 7/1978 | Franklin et al. | |
| 4,310,797 | A | 1/1982 | Butler | |
| 4,634,974 | A | 1/1987 | Hunter | |
| 4,700,489 | A | 10/1987 | Vasile | |
| 4,896,131 | A | 1/1990 | Podlesny et al. | |
| 4,944,096 | A | 7/1990 | Tolley | |
| 5,148,108 | A | 9/1992 | Dufour | |
| D339,074 | S | 9/1993 | Dufour | |
| D374,595 | S | 10/1996 | Welder | D8/14 |
| 5,793,200 | A | 8/1998 | Berrill | 324/207 |
| 6,211,662 | B1 * | 4/2001 | Bijawat et al. | 324/67 |
| 6,229,294 | B1 | 5/2001 | Wun | 324/67 |
| 6,456,053 | B1 | 9/2002 | Rowley | 324/67 |
| 6,674,276 | B2 * | 1/2004 | Morgan et al. | 324/67 |

* cited by examiner

*Primary Examiner*—Elvin Enad
*Assistant Examiner*—Bernard Rojas

(57) ABSTRACT

A device for locating ferrous objects that are visually obscured by a non-magnetic surface material and for temporarily magnetically holding a ferrous fastener in position to be affixed including at least on magnet having sufficient strength to attract and locate the ferrous object to be detected, hold the weight of the device onto the non-magnetic surface and the strength to hold at least one fastener to be affixed in an affixing position with the affixing position being at least ¼" away from the magnetic center of the magnet and directly vertically above or below the magnetic center.

8 Claims, 8 Drawing Sheets

FERROUS FASTENER STARTER AND FERROUS OBJECT LOCATOR

BACKGROUND—FIELD OF INVENTION

This present invention relates generally to ferrous fastener starters and ferrous object locators, specifically fastener starters used to hold fasteners in place before affixing, specifically affixing by hammering or screwing in place, concurrently to such magnetic object locators used in attracting to nail/screw heads hidden from sight by paint and/or plaster, specifically one tool that does both jobs.

BACKGROUND—DESCRIPTION OF PRIOR ART

Heretofore ferrous magnetic object locator products and fastener starting products were separate tools. Magnetic ferrous object locator products are known in prior art. For example:

U.S. Pat. No. 6,456,053 entitled METAL DETECTOR FOR FINDING WALL STUDS,

U.S. Pat. No. 6,696,827 entitled MAGNETIC STUD LOCATOR ADAPTED TO PROVIDE VISUAL REF . . .

U.S. Pat. No. 5,148,108 entitled STUD FINDER WITH LEVEL INDICATOR.

U.S. Pat. No. 3,845,384 entitled STUD FINDER

U.S. Pat. No. 4,700,489 entitled SQUARE LEVEL MEASURING TOOL

U.S. Pat. No. 4,896,131 entitled STUD FINDER WITH ONE-PIECE MAGNET ASSEMBLY

U.S. Pat. No. 5,148,108 entitled STUD FINDER WITH LEVEL INDICATOR

In each of these prior art references, magnet(s) are attracted to nails, screws or steel studs. These devices are moved across the wall manually to where the magnet attracts most strongly. Then a mark is made on the wall at that point. The device will not hang on the wall and is removed after the mark is made. The new fastener is then held on the mark by hand. Then the fastener is started to be affixed by hammering, screwing or some method. Then the operator's hand may release the fastener. Then the fastener is fully affixed. U.S. Pat. No. 6,696,827 entitled MAGNETIC STUD LOCATOR ADAPTED TO PROVIDE VISUAL REFERENCE and U.S. Pat. No. 6,456,053 are the only references found wherein the device will hang magnetically on the wall in order to provide a "visual reference". They serve as a finding device, but will not serve dually as a fastener starter. They will not hold the new nail/screw in position for starting. Upon starting a fastener with a hammer, the device falls off the wall due to the impact of the hammer. Therefore a mark is still required to be made where the fastener is to be affixed. The device is removed from the wall before the fastener will be affixed.

The above described magnetic object locators are adequate for finding a ferrous object which is hidden from sight. However, prior art requires the additional processes of: 1) finding a marking device 2) picking up a marking device when your hands may be busy holding the finding device 3) finding the correct place to mark the wall or non-ferrous surface 4) marking the wall in the correct place 4) putting down the marking device 5) putting down the finding device 6) finding a fastener 7) aligning the fastener with the mark 8) holding the fastener in position to be affixed 9) starting the fastener to be affixed. These processes are unnecessary with my invention.

Fastener starting products have been known in prior art. For example:

U.S. Pat. No. 4,766,782 entitled SCREW AND NAIL GUIDE

U.S. Pat. No. 3,946,779 entitled NAIL GUIDE

U.S. Pat. No. 6,038,945 entitled NAIL STARTER INTEGRALLY FORMED WITH HEAD OF HAMMER U.S. Pat. No. 5,933,894 entitled COMBINATION TOOL WITH NAIL STARTER U.S. Pat. No. 5,852,959 entitled NAIL STARTER FOR HAMMER U.S. Pat. No. 4,221,248 entitled NAIL HOLDER In each of these prior art references magnets are not used.

Fastener starting products using magnets have been known in prior art. For example, U.S. Pat. No. 4,667,747 entitled NAIL STARTER. A magnet is used to hold a nail in a groove while a hammer starts the nail. However the magnet is not the right size or shape to create a magnetic field sufficiently deep for locating a fastener hidden from sight. Magnetic nail holders on the market have been made only with a short magnetic field for holding the nail.

The above described magnetic object locators are adequate for finding a ferrous object, which is hidden from sight. The above described magnetic nail starters are adequate for starting fasteners. However, these prior art references suffer from a number of certain deficiencies:

a) They serve as a finding device, but will not serve dually as a fastener starter.

b) They serve as a fastener starting device, but will not serve dually as a finding device.

c) They require finding a marking device.

d) They require picking up a marking device when your hands may be busy holding the finding device.

e) They require finding the correct place to mark the wall or non-ferrous surface.

f) They require marking the wall in the correct place.

g) They require putting down the marking device.

h) They require putting down the finding device.

i) They require finding a fastener.

j) They require aligning the fastener with the mark.

k) They require holding the fastener in position to be affixed by hand.

l) They require starting the fastener to be affixed, with fingers in a dangerous position.

m) They may require cleaning the mark off the non-ferrous surface.

n) These devices are not effective at locating ferrous fastener heads, ferrous objects and steel studs.

o) These devices are not effective at hanging magnetically and vertically from hidden ferrous fastener heads, ferrous objects and steel studs in a vertical line with a stud.

p) These devices do not provide a magnetic object locator and magnetic fastener starter which is effective for holding a fastener perpendicular to the mounting surface, away from hidden fastener in the mounting surface, in a vertical line with hidden fasteners in the mounting surface, ready to be affixed.

q) These devices do not provide a magnetic object locator and magnetic fastener starter which is effective for holding a fastener ready to be affixed with hands free from the dangerous working area of the hammer, screwdriver or affixing tool.

SUMMARY

In accordance with the present invention one device for locating ferrous object(s) that are visually obscured by a non-magnetic surface material and for temporarily holding a mostly ferrous fastener in the correct position to be affixed until firmly started.

OBJECTS AND ADVANTAGES

Accordingly, besides the objects and advantages of the magnetic object locator and magnetic fastener starter described in my above patent, several objects and advantages of the present invention are:

(a) to provide a magnetic object locator and magnetic fastener starter which is one tool, saving job time, saving material costs, saving space.

(b) to provide a magnetic object locator and magnetic fastener starter which is one tool, saving job time, saving material costs, saving space.

(c) to provide a magnetic object locator and magnetic fastener starter which does not require finding a marking device.

(d) to provide a magnetic object locator and magnetic fastener starter which does not require picking up a marking device when your hands may be busy holding the finding device.

(e) to provide a magnetic object locator and magnetic fastener starter which does not require finding the correct place to mark the wall or non-ferrous surface.

(f) to provide a magnetic object locator and magnetic fastener starter which does not require marking the wall in the correct place.

(g) to provide a magnetic object locator and magnetic fastener starter which does not require putting down the marking device.

(h) to provide a magnetic object locator and magnetic fastener starter which does not require putting down the finding device.

(i) to provide a magnetic object locator and magnetic fastener starter which does not require finding a fastener.

(j) to provide a magnetic object locator and magnetic fastener starter which does not require aligning the fastener with the mark.

(k) to provide a magnetic object locator and magnetic fastener starter which does not require holding the fastener in position to be affixed by hand.

(l) to provide a magnetic object locator and magnetic fastener starter which does not require starting the fastener to be affixed with fingers in a dangerous position.

(m) to provide a magnetic object locator and magnetic fastener starter which does not require cleaning the mark off the non-ferrous surface.

(n) to provide a magnetic object locator and magnetic fastener starter which is effective for magnetically locating hidden ferrous fastener heads, ferrous objects and steel studs.

(o) to provide a magnetic object locator and magnetic fastener starter which will hang magnetically and vertically from the hidden ferrous fastener heads, ferrous objects and steel studs in order to be in line with the hidden studs.

(p) To provide a magnetic object locator and magnetic fastener starter which is effective for holding a fastener perpendicular to the mounting surface, away from hidden fastener in the mounting surface, in a vertical line with hidden fasteners in the mounting surface, ready to be affixed.

(q) To provide a magnetic object locator and magnetic fastener starter which is effective for holding a fastener ready to be affixed with hands free from the dangerous working area of the hammer, screwdriver or affixing tool.

BRIEF DESCRIPTION OF THE DRAWINGS

The features of this present invention will become more apparent upon reference to the drawings wherein.

REFERENCE NUMERALS IN DRAWINGS

Figure 1:
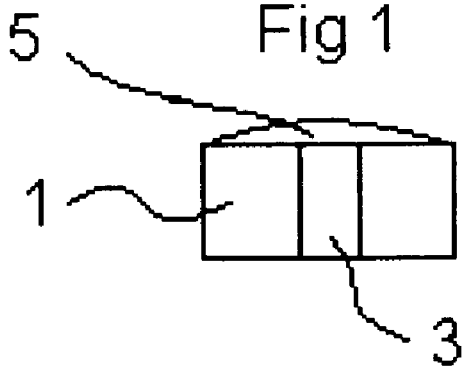
FIG. 1 is an end perspective of the fastener starter and ferrous object locator of this present invention.
Figure 2:
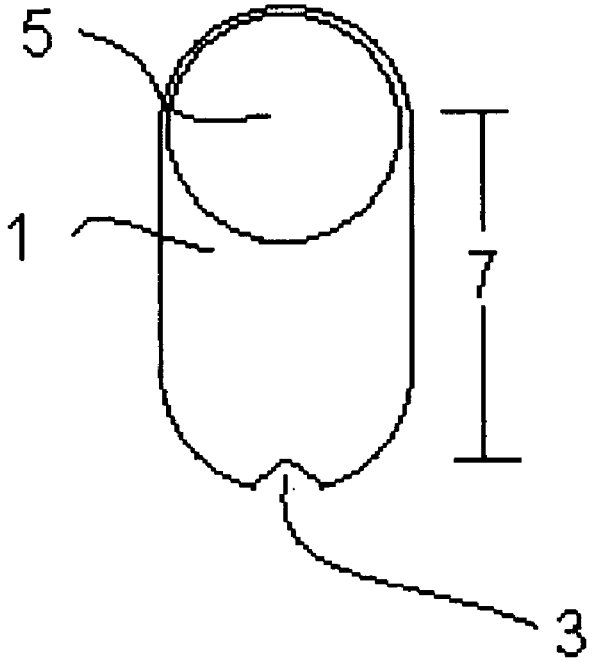
FIG. 2 is a top perspective of the fastener starter and ferrous object locator of this present invention.
Figure 3:
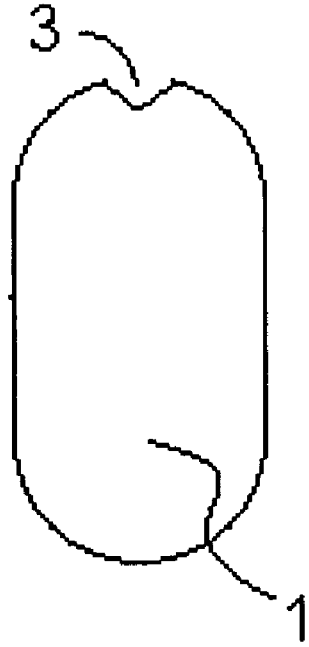
FIG. 3 is a bottom perspective of the fastener starter and ferrous object locator of this present invention.
Figure 4:
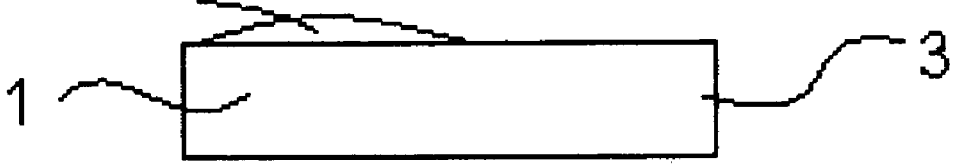
FIG. 4 is side perspective of the fastener starter and ferrous object locator of this present invention.

1 Magnet
2 Steel
3 Groove
4 Enclosure
5 Pivot
6 Through hole
7 Distancing means from magnetic center to groove

DETAILED DESCRIPTION OF THE INVENTION

The preferred embodiment shown is not meant to limit this present invention but to illustrate. A preferred embodiment of the present invention is illustrated in FIG. 1–4. This present invention, in its simple form, consists of a magnet with a groove. FIG. 1–4 are different views of a preferred embodiment. The magnet 1 is round ended in periphery shape. This round ended shape is particularly suited for holding the magnet 1 to a ferrous fastener with a round head. This round ended shape magnet 1 is also particularly suited to magnetically centering on a round fastener head. A square magnet may be used but is a waste of magnet material and does not have the same centering ability. The magnet 1 is about equal to the size of the round fastener head to be found. For example a ⅜" diameter fastener head would be best located with a ⅜" diameter, magnet 1. For purposes of simplifying the number of materials used a round ended magnet may be used instead of a disc shaped magnet. The depth of the magnetic field of the magnet 1 can be varied by increasing the magnet 1 thickness. If the non-ferrous surface is thicker than the normal ⅛" to ½" then the thickness of the magnet 1 must be increased. The strength of the magnet 1 can also be varied by changing the magnetic material. The magnet 1 therefore must be strong enough to locate and hang magnetically on the ferrous object hidden behind a non-ferrous surface.

The groove 3 is "V" shaped and runs straight though the thickness of the device. The groove 3 is located on the periphery of the device. The groove 3 is required to hold the fastener to be affixed in the affixing position. The groove 3 must be distanced at least one diameter of an average fastener head (about ⅜") away from the holding center of the magnet. The holding center of the magnet 1 is that point where the magnet 1 will hang on a vertical surface attracting and roughly centered on a hidden fastener. In order the keep the groove 3 distanced from the magnet 1 holding centered position, the magnet is round ended, instead of disc shaped, in this preferred embodiment. The magnet 1 periphery is therefore oval with a "V" shaped groove 3 on one end. This assures that the new fastener to be affixed will not be started on top of the head of an existing hidden fastener. The pivot 5 assures that the groove 3 will hang vertically below the hidden fastener. The pivot 5 may not be necessary if the counterweight of the device is sufficient to cause the device to hang straight down.

An alternate function of the magnet 1 being able to hang on the wall magnetically is that a plumb line can be attached to the magnet 1. A plumb line is wrapped around the tool and hangs down vertically. This gives a visual reference to where the hidden stud is located. It is not necessary to use the plumb line in the process of mounting the fastener.

Figure 5:
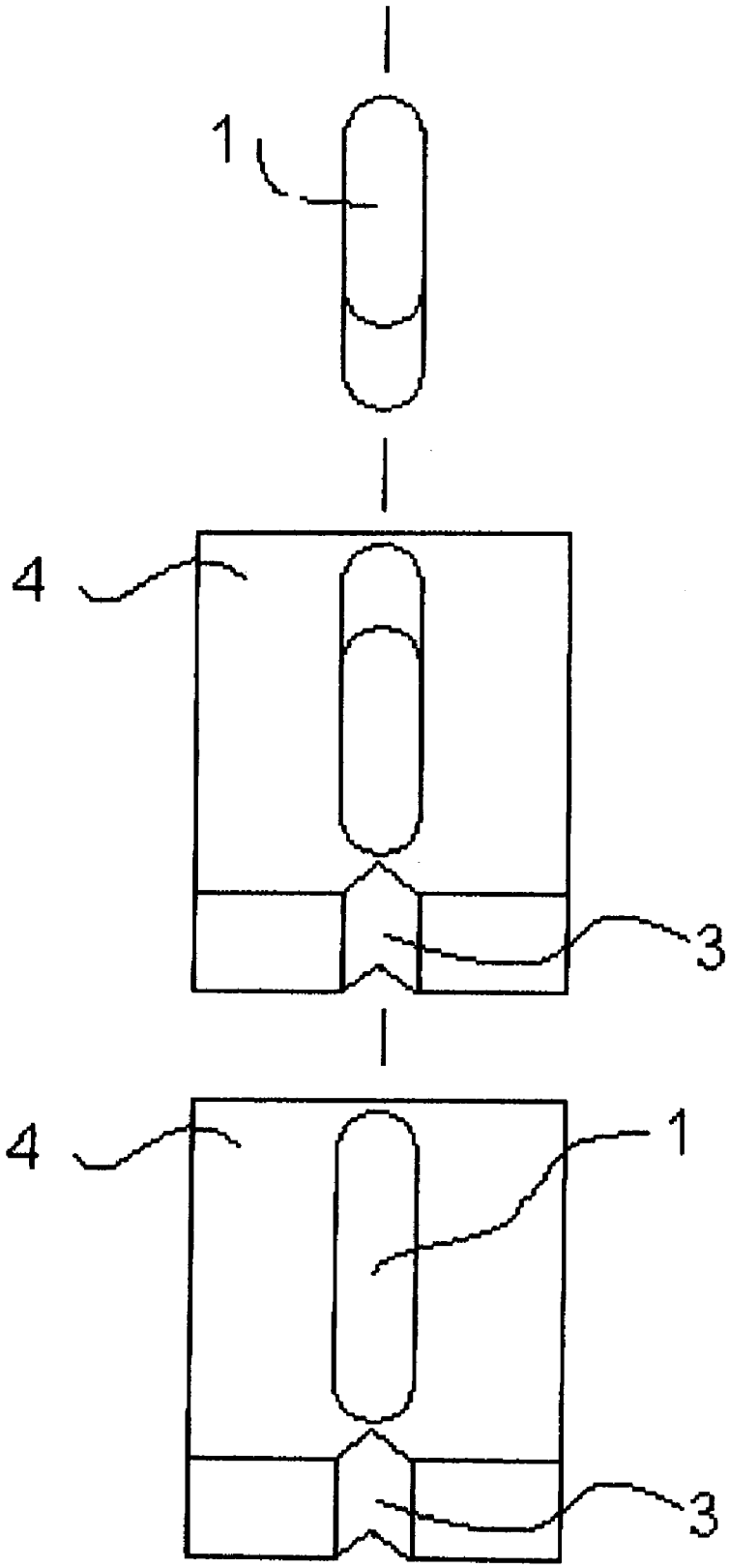
FIG. 5 is a two dimensional view of an alternative embodiment of FIG. 1 with a partial enclosure.

FIG. 5 is a two dimensional view of an alternatively configured magnet 1 and groove 3 utilizing an enclosure 4 for distancing the groove 3 from the magnet 1. The enclosure 4 also serves to protect the magnet 1.

Figure 6:
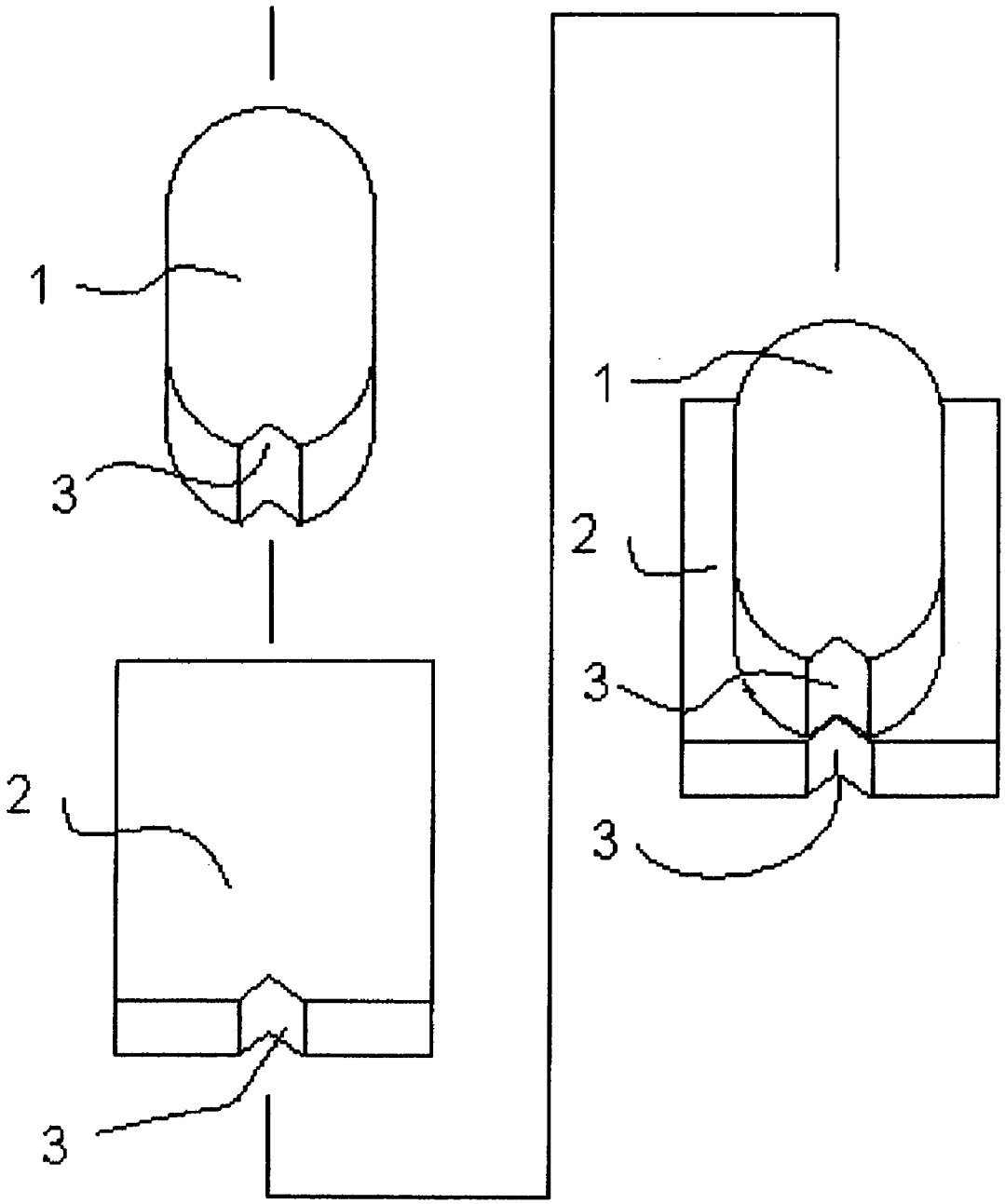
FIG. 6 is a two dimensional view of an alternative embodiment of FIG. 1 with a steel plate.

FIG. 6 is a two dimensional view of an alternatively configured magnet 1 and groove 3 utilizing a steel 2 for distancing the groove 3 from the magnet 1. The steel 2 also serves to protect the magnet 1. The steel 2 also serves to increase the usable magnetic field.

Figure 7:
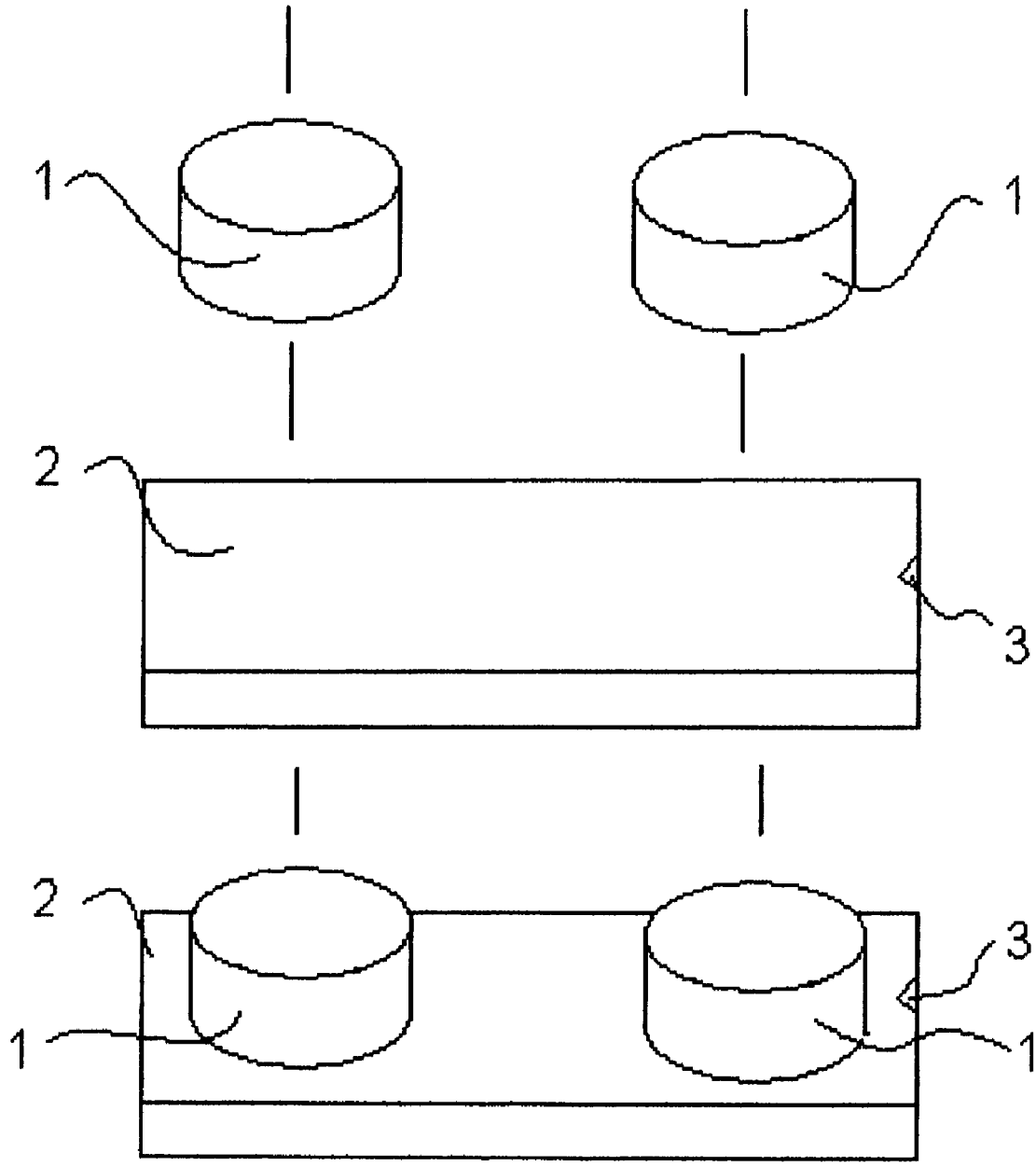
FIG. 7 is a two dimensional view of an alternative embodiment of FIG. 1 with a steel plate and two magnets.

FIG. 7 is a two dimensional view of an alternatively configured magnet 1 and groove 3 utilizing a steel 2 for distancing the groove 3 from the holding center of the holding magnet 1. An additional magnet 1 serves to increase the searching area when locating hidden ferrous objects. The steel 2 also serves to protect the magnets 1. The steel 2 also serves to increase the usable magnetic field.

Figure 8:
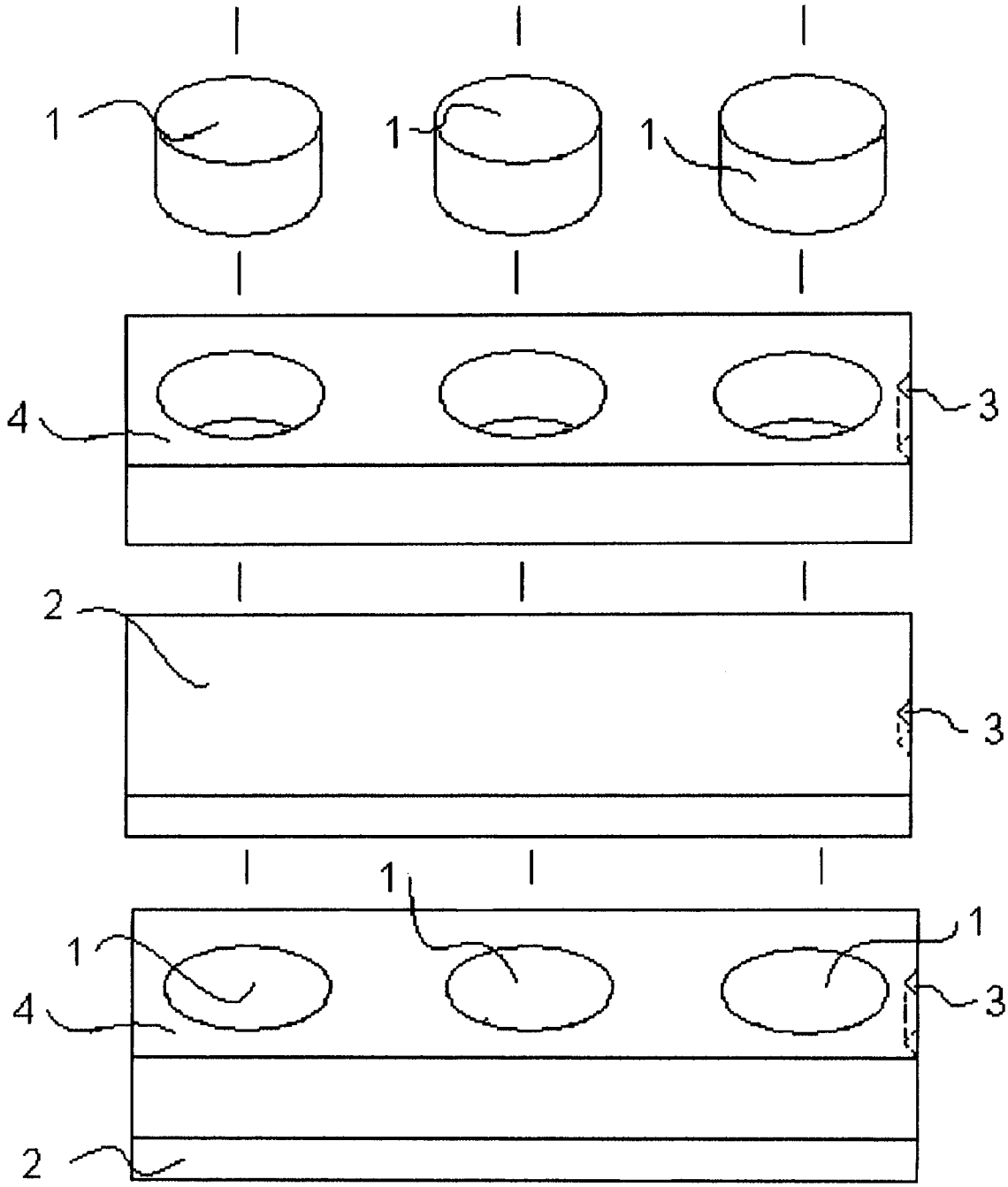
FIG. 8 is a two dimensional view of an alternative embodiment of FIG. 1 with partial enclosure, three magnets and a steel plate.

FIG. 8 is a two dimensional view of an alternatively configured magnet 1 and groove 3 utilizing a steel 2 and a partial enclosure 4 for distancing the groove 3 from the holding center of the holding magnet 1. Two additional magnets 1 serve to increase the searching area when locating hidden ferrous objects. The steel 2 also serves to protect the magnets 1. The steel 2 also serves to increase the usable magnetic field. The enclosure 4 also serves to protect the magnets 1.

Figure 9:
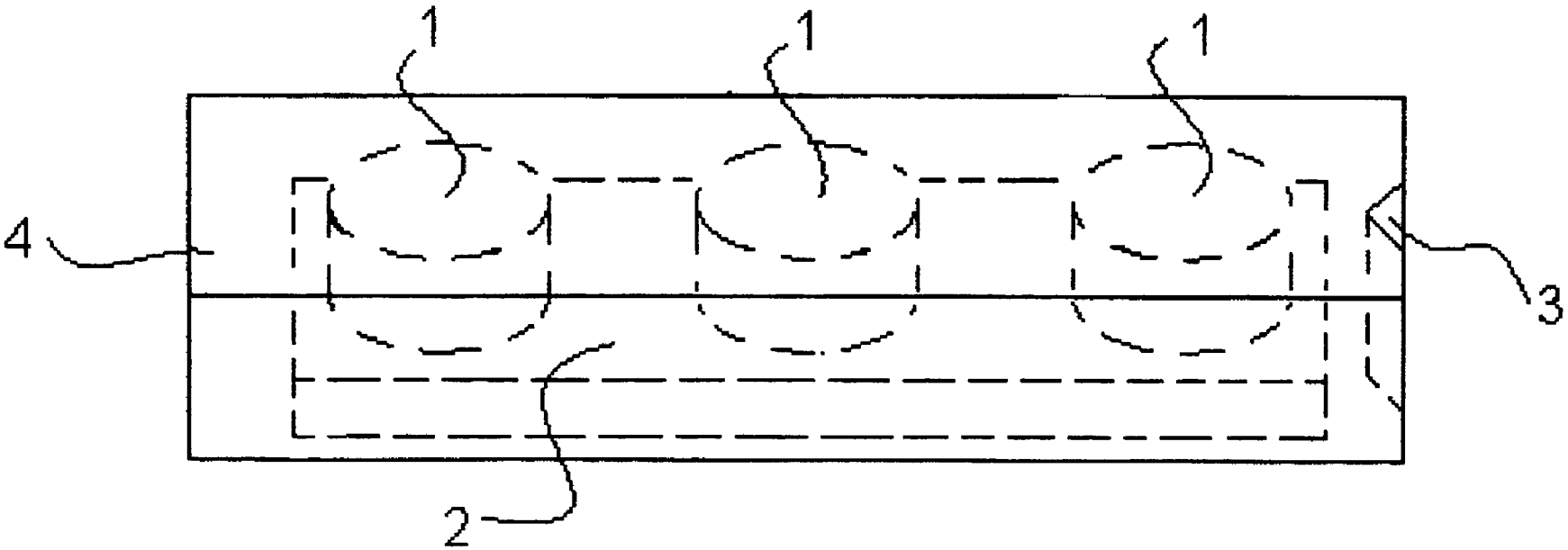
FIG. 9 is a two dimensional view of an alternative embodiment of FIG. 1 with a full enclosure, three magnets and a steel plate.

FIG. 9 is a two dimensional view of an alternatively configured magnet 1 and groove 3 utilizing a steel 2 and a full enclosure 4 for distancing the groove 3 from the holding center of the holding magnet 1. Two additional magnets 1 serve to increase the searching area when locating hidden ferrous objects. The steel 2 also serves to protect the magnets 1. The steel 2 also serves to increase the usable magnetic field. The enclosure 4 also serves to protect the magnets 1 and the steel 2.

Figure 10:
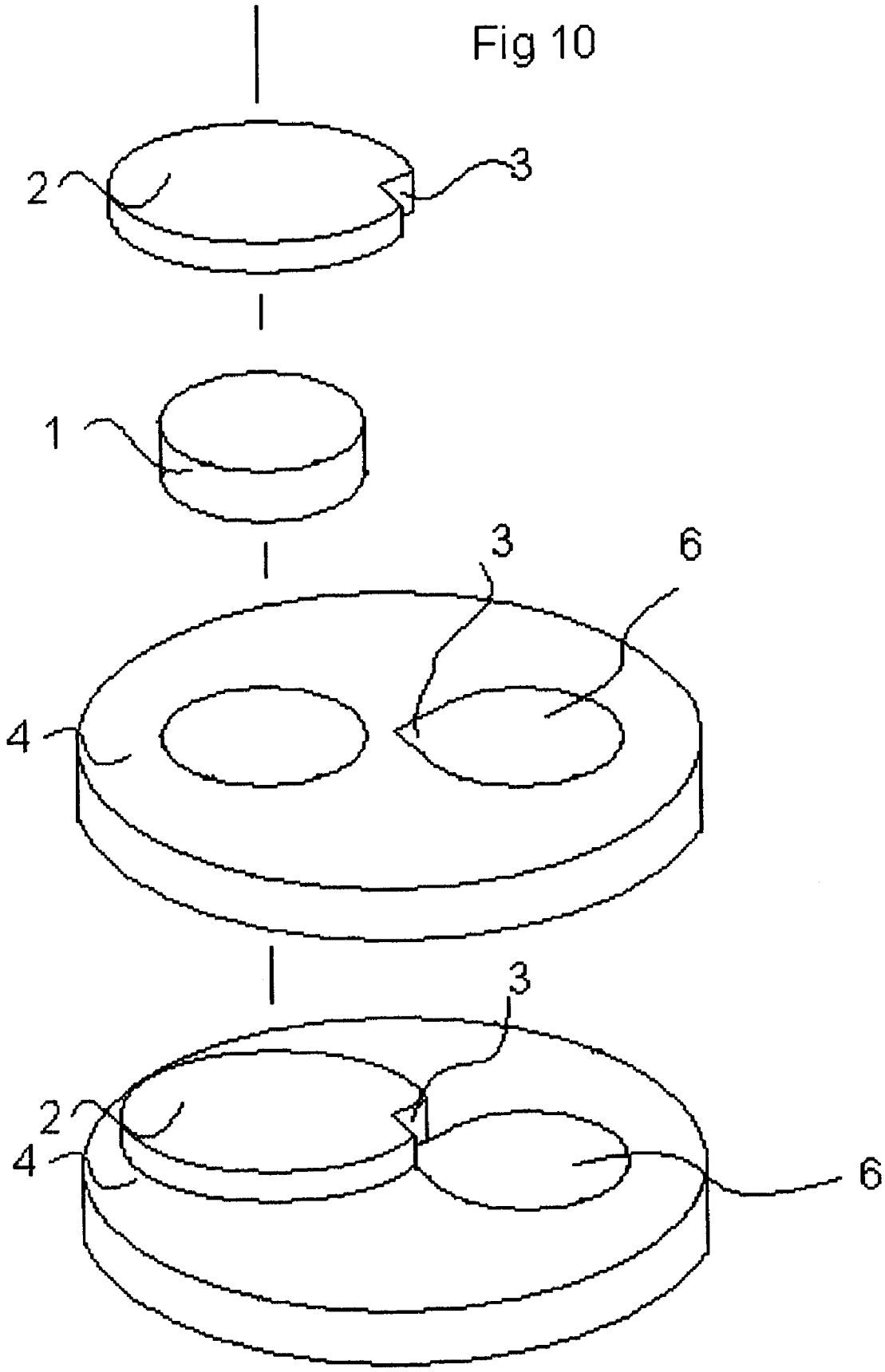
FIG. 10 is a two dimensional view of an alternative embodiment of FIG. 1 with a partial enclosure, one magnet, a steel plate and a through hole.

FIG. 10 is a two dimensional view of an alternatively configured magnet 1 and groove 3 utilizing a steel 2 and a partial enclosure 4 for distancing the groove 3 from the holding center of the holding magnet 1. The steel 2 also serves to protect the magnet 1. The steel 2 also serves to increase the usable magnetic field. The enclosure 4 also serves to protect the magnet 1. The through hole in large enough for the fastener head to pass through once the fastener is started. The through hole will keep the device from falling while the fastener is being started. Therefore no hands are needed to hold the fastener in starting position and risk getting hammered or punctured by a screw driver. No marking of the wall is required. The through hole 6 may also be used to attach a plumb line. The plumb line is useful as a visual reference to where the hidden stud should be. The plumb line may also be used from any ferrous object. It is not necessary to use the plumb line in the process of mounting the fastener.

Figure 11:
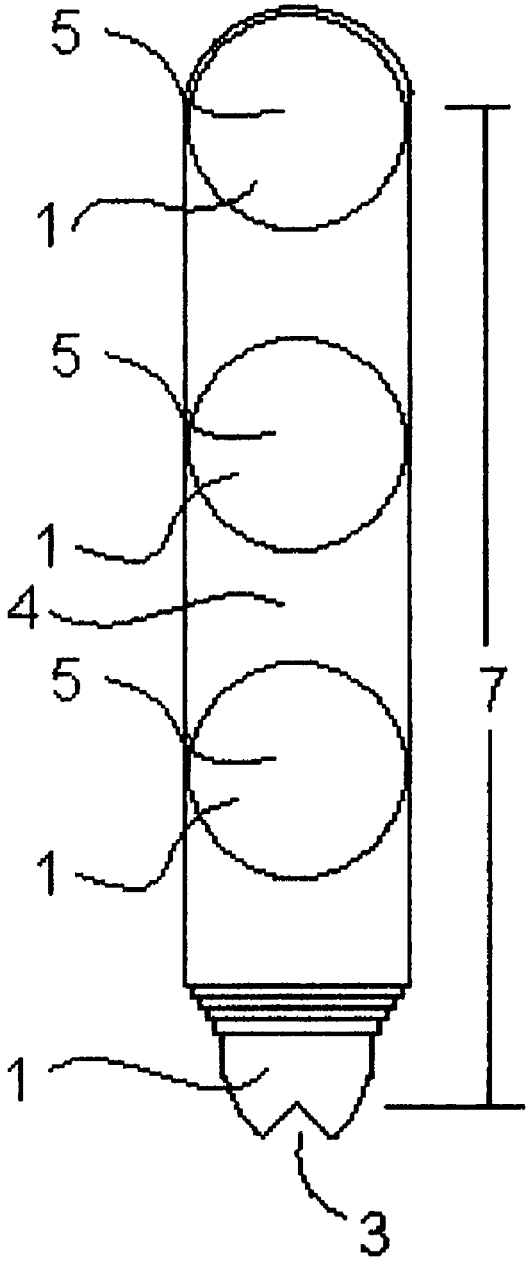
FIGS. 11 & 12 is a one dimensional view of as alternative embodiment of FIG. 1 with an additional mechanical method of adjusting the distance from the magnetic center to the groove.
Figure 12:
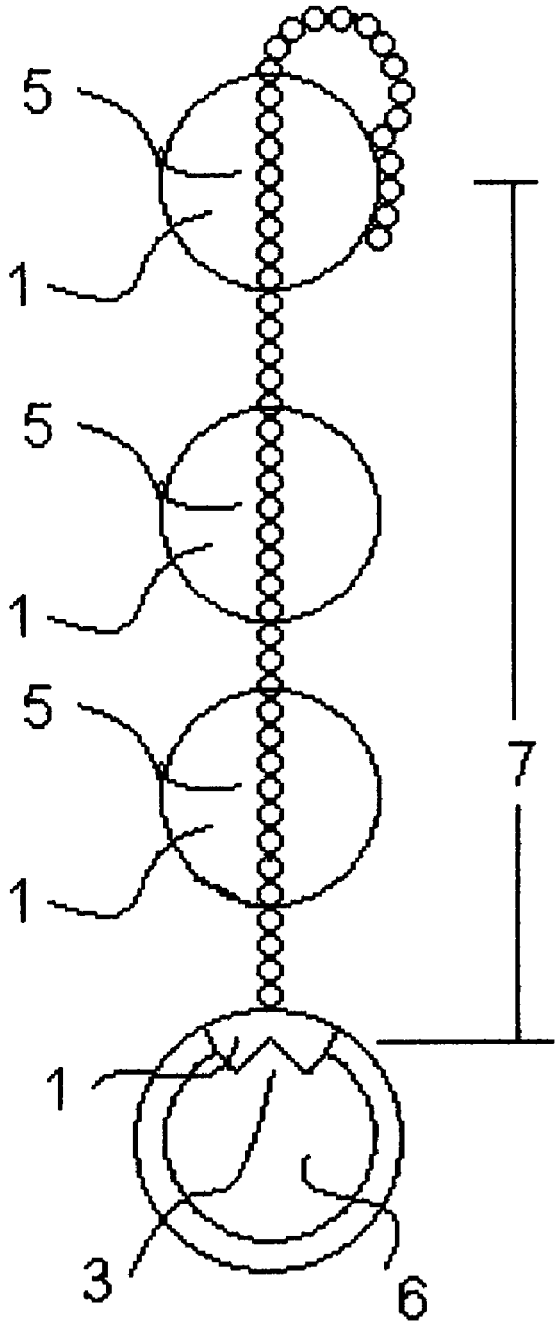

FIGS. 11 & 12 are alternate embodiments of the device utilizing mechanical means to adjust the distance from the magnetic center pivot 5 to the fastener starter groove 3

Advantages

From the description above, a number of advantages of my ferrous fastener starter and ferrous object locator become evident:

a) One tool to start a ferrous fastener and locate ferrous objects has less parts and saves material costs.
b) One tool to start a ferrous fastener and locate ferrous objects saving job time; no need to switch tools, etc.
c) One tool to start a ferrous fastener and locate ferrous objects saves space and is easier to carry.
d) My invention will hang magnetically and vertically from the hidden old fastener head while holding the new fastener in the correct position to be affixed, therefore obviating the need for a marking device, therefore reducing material costs.
e) My invention will hang magnetically and vertically from the hidden old fastener head while holding the new fastener in the correct position to be affixed, therefore obviating the need for the marking process; finding a marking device, picking it up, aligning the mark, marking the surface, erasing incorrect marks, putting the device away, therefore reducing job time.
f) One tool to start a ferrous fastener and locate ferrous objects obviates the need for a marking device, therefore saving toolbox or pocket space.
g) A tool that hangs on the wall magnetically obviates the need to put the tool down and allows the operator to perform other tasks without losing that location.
h) A tool that will provide a magnetic "v" slot, perpendicular to the mounting surface, at a precisely measured distance away from an affixed hidden fastener head and aligned vertically with that head, provides for consistently correct placement of the new fastener to be affixed, as opposed to visually aligning a mark on the wall and then visually aligning the fastener with a mark by hand.
i) A tool to start a ferrous fastener and locate ferrous objects that holds the fastener in the correct position to be affixed while holding it a safe distance from the hand; avoiding hammering or screwing dangerously towards your hand.

j) A tool that provides a magnetic object locator and magnetic fastener starter which can pick up ferrous objects.

k) A tool which can hold a few of the new fasteners to be affixed while the operator is magnetically locating old hidden fasteners, therefore does not require looking for a new fastener and picking it up.

1) The magnet can hold itself and a plumb line to a ferrous object in the wall; providing a visual reference for the hidden stud.

Operation

The manner of using the tool to locate ferrous objects and start a ferrous fastener is simple. Namely a few fasteners can be picked up with the magnet and moved to any side not being used to locate old hidden fasteners. One new ferrous fastener is placed on the magnet 1, in the magnetic "v" groove 3. The tool is placed on the non-ferrous mounting surface (wall) with the strong magnetic side facing the wall. The tool is slid over the wall surface until magnetic resistance is felt. This resistance is caused by the magnet 1 attraction to the hidden ferrous fastener. The tool is then centered manually and magnetically to the strongest point of attraction. The tool is released. The tool will hang magnetically vertically. The weight of the device causes the groove 3 to align vertical to the hidden ferrous fastener and over the stud. The operator may then attach a plumb line to the magnet (optional). Then the operator can step back and see if the fastener location is visually correct. The tool is held by hand if needed. The new ferrous fastener is then started to be affixed by hammering, screwing, etc. Then the tool is removed. Then the fastener is finished being affixed.

Conclusion, Ramifications, and Scope

Accordingly, the reader will see that the single tool to locate ferrous objects and start a ferrous fastener of this invention can be used to position and mount fasteners quickly and easily. A tool combining a magnetic locator of fasteners and a magnetic starter of fasteners is less expensive than two tools. The combined tool also saves the operator job time and work space. Furthermore the tool has additional major benefits in that:

The operator does not need a marking device (cost of the device, finding the device, handling the device);

The operator does not need to do the marking process (positioning the mark, making the mark, erasing the mark(s));

The tool is magnetically able to hang on the wall while holding the fastener in correct position to be affixed; therefore no hand is placed in a dangerous hammering or screwing area.

The groove positions the fastener to be affixed, perpendicular to the mounting surface, away from the hidden fastener, vertically aligned with the hidden stud.

The tool can be enclosed fully or partially in any non-magnetic material to protect the tool from damage due to impact of falling, hammering or screwing.

The tool can magnetically hold a few new fasteners during the locating of hidden ferrous objects. One new fastener is held in the groove ready to be affixed.

The tool is compact, small enough to fit in a pocket

The tool is magnetically able to hang vertically on the wall with an optional plumb line.

The invention claimed is:

1. A device for locating ferrous objects that are visually obscured by a non-magnetic surface material and for temporarily magnetically holding a ferrous fastener in position to be affixed including at least on magnet having sufficient strength to attract and locate the ferrous object to be detected that is visually obscured by the non-magnetic surface material, hold the weight of the device onto the non-magnetic mounting surface by attracting the ferrous object disposed behind the non-magnetic mounting surface and the strength to hold at least one fastener to be affixed in an affixing position with the affixing position being at least ¼" away from the magnetic center of the magnet and directly vertically above or below the magnetic center.

2. The device of claim 1 wherein the device while suspended magnetically from the visually obscured fastener, will pivot on the magnetic center, rotating the heavier end down by gravitational force and simultaneously rotating the linear groove into a vertical position above or below the magnetic center.

3. The device of claim 1 wherein said at least one magnet is disposed at least partially in a non-magnetic enclosure.

4. The device of claim 1 wherein said at least one magnet is multiple magnets disposed in a non-magnetic enclosure.

5. The device of claim 1 wherein said at least one magnet is affixed to a ferrous metal plate, said plate being no larger than 3 times wider, 3 times longer and 1 time as thick as said magnet, said device being mostly attracting towards the ferrous object to be located and mostly non-magnetic on the side away from the ferrous object.

6. The device of claim 1 wherein said device has a through hole to attach a plumb line.

7. The device of claim 1 wherein the distance from the magnetic center pivot to the fastener starter groove is adjustable by making the at least partial enclosure a longer solid piece or by making the at least partial enclosure length adjustable by mechanical means.

8. The device of claim 1 wherein the device while suspended magnetically from the visually obscured fastener, will pivot on the magnetic center, rotating the heavier end down by gravitational force and simultaneously rotating the linear groove into a vertical position above or below the magnetic center, having multiple magnets, having a ferrous metal plate, being disposed at least partially in a non-magnetic enclosure, with a through hole to attach a plumb line.

* * * * *